United States Patent [19]

Sher

[11] Patent Number: 4,589,530

[45] Date of Patent: May 20, 1986

[54] COLLAPSIBLE WHEELED LUGGAGE WITH STIFFENER

[76] Inventor: Yuh Y. Sher, 4 Fl., No. 30, Alley 6, Lane 995, Ming Shen E. Rd., Taipei, Taiwan

[21] Appl. No.: 749,094

[22] Filed: Jun. 26, 1985

[51] Int. Cl.[4] ..... A45C 13/36

[52] U.S. Cl. ..... 190/18 A; 190/103; 190/107; 190/127

[58] Field of Search ..... 190/18 A, 103, 107, 190/127; 16/29, 31 R, 31 A; 280/79.1 R, 79.1 A

[56] References Cited

U.S. PATENT DOCUMENTS

| | | | |
|---|---|---|---|
| 2,710,084 | 6/1955 | Braverman | 190/107 |
| 3,608,921 | 9/1971 | Wilson | 280/79.1 R |
| 3,987,875 | 10/1976 | Szabo | 190/18 A |
| 4,418,804 | 12/1983 | Bradley et al. | 190/18 A |

FOREIGN PATENT DOCUMENTS

| | | | |
|---|---|---|---|
| 163331 | 6/1949 | Austria | 190/18 A |
| 2022997 | 12/1979 | United Kingdom | 190/18 A |

*Primary Examiner*—William Price
*Assistant Examiner*—Gary E. Elkins
*Attorney, Agent, or Firm*—Bacon & Thomas

[57] ABSTRACT

An improved luggage comprising a main body portion, a lid hingedly attached to one side of the main body portion, a zipper fastener provided on the main body portion and the lid, a supporting frame fastened on the inner sides of the main body portion, four casters mounted on the bottom of the main body portion, two fixing members engageable with the casters and a stiffening board capable of engaging with the casters, whereby when not in use the improved luggage may be reduced in volume thereby facilitating the storage and transportation of the luggage.

3 Claims, 4 Drawing Figures

COLLAPSIBLE WHEELED LUGGAGE WITH STIFFENER

BACKGROUND OF THE INVENTION

This invention relates to an improved soft-sided luggage.

As a result of rapid population growth, many people are engaging in travelling as leisure activity to relieve day to day stress. Accordingly, the need has arisen for travelling trunk. The most commonly type of luggage is soft-sided luggage, which is formed of pliant material. One of the walls of the soft-sided luggage is hingedly mounted and constitues a cover for the container portion of the luggage. However, the soft-sided luggage is easily damaged at the bottom and cannot be reduced in volume when not in use.

It is, therefore, an object of the present invention to provide an improved travelling trunk which may obviate and mitigate the above-mentioned drawbacks.

SUMMARY

The present invention relates to a luggage and in particular to an improved soft-sided luggage which can be reduced in volume when not in use. It is the primary object of the present invention to provide an improved luggage the bottom of which may not be damaged by its casters.

It is another object of the present invention to provide an improved luggage the wheels of which may be prevented from separating from its bottom.

It is still another object of the present invention to provide an improved luggage which may be largely reduced in volume when not in use.

It is still another object of the present invention to provide an improved luggage which is durable in use.

It is further object of the present invention to provide an improved luggage which is easy to move.

While the invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
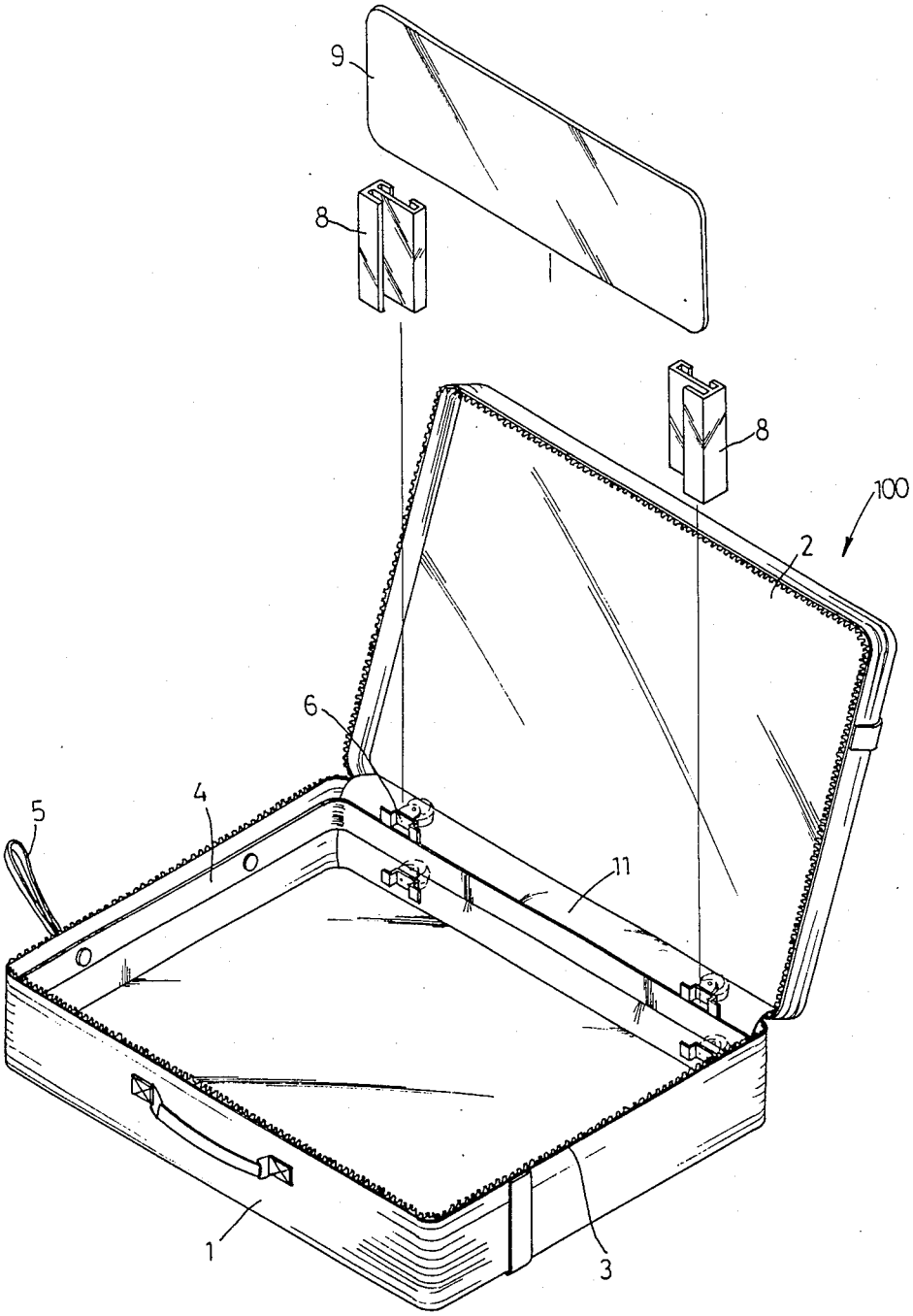
FIG. 1 is an exploded view of an improved luggage according to a preferred embodiment of the present invention.

With reference to the drawings and in particular to FIG. 1 thereof, the improved luggage 100 according to the present invention is shown having a main body portion 1, a pair of fixing members 8, and a stiffening board 9. The main body portion 1 has a lid 2 hingedly attached to one side thereof. The main body portion 1 and the lid are formed of pliant material, such as real or imitation leather, for example. A closure means 3 such as a zipper fastener is provided on the main body portion 1 and the lid 2 for zipping up the improved luggage 100. A supporting frame 4 is fastened on the inner sides of the main body portion 1 and at a level intermediate the height thereof. Affixed to one side of the main body portion 1 is a pull strap 5 which takes the form of a loop so as to facilitate the manual act of pulling the improved luggage. On the bottom side 11 of the main body portion 1 are mounted four casters 6.

Figure 2:
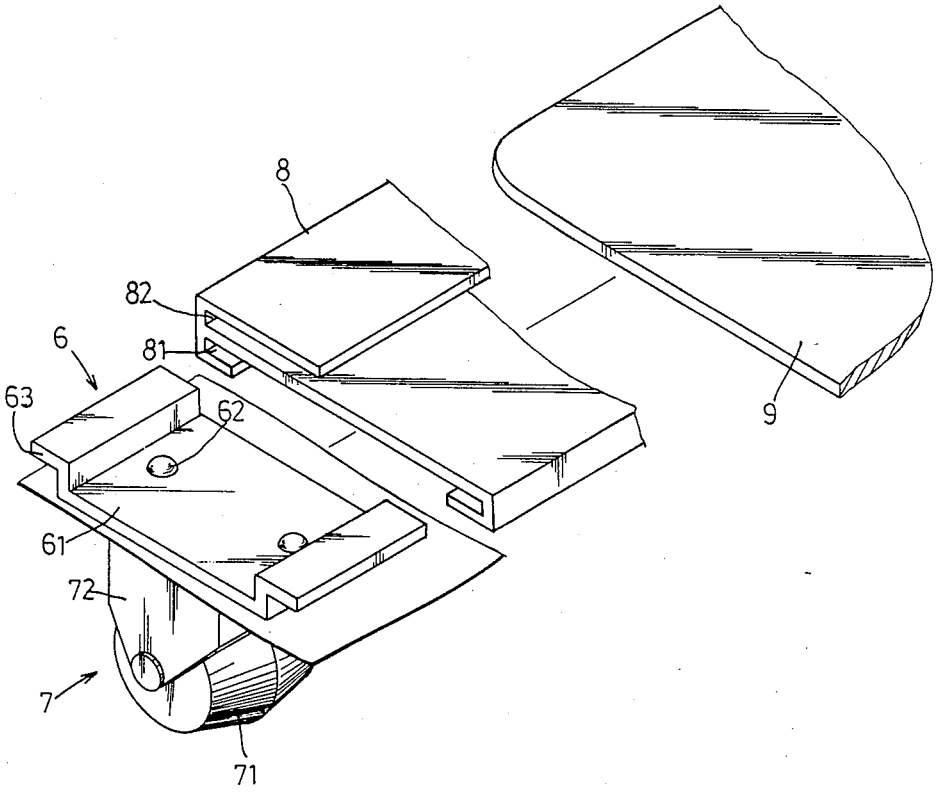
FIG. 2 shows the relationship between the caster, the fixing member and the stiffening board.
Figure 3:
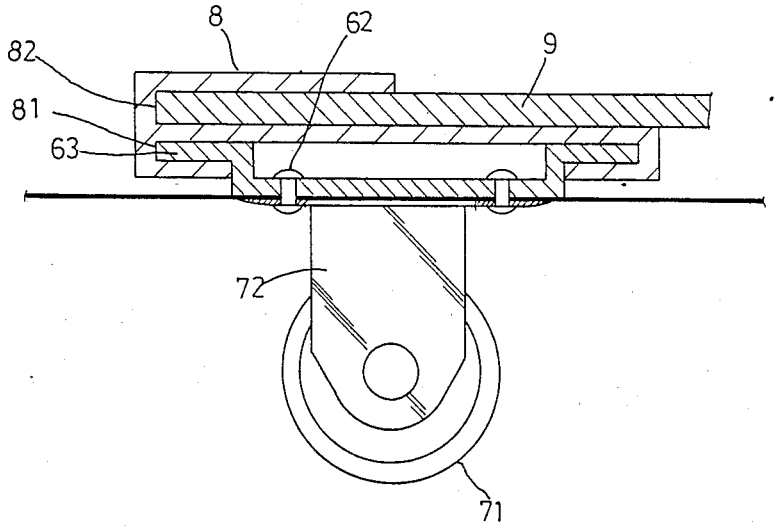
FIG. 3 is fragmentary sectional view of the improved luggage.
Figure 4:
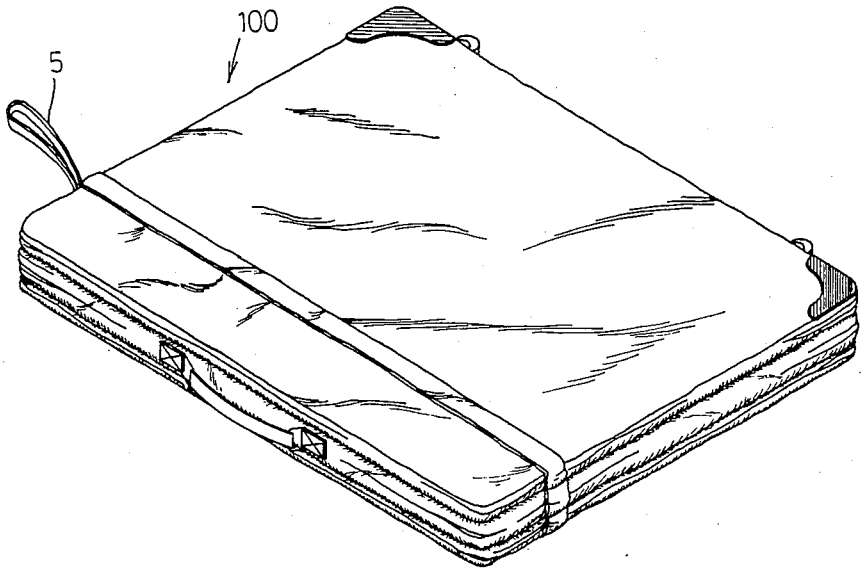
FIG. 4 is a perspective view showing the collapsed condition of the improved luggage.

As shown in FIG. 2, each caster 6 comprises a mounting plate 61 fixedly attached to the inner side of the bottom side 11 of the main body portion 1 and a wheel assembly carrying wheel 71. The wheel assembly 7 includes a bracket 72 connected with the mounting plate 61 via rivets 62 and a wheel 71 rotatably mounted in the bracket 72. The mounting plate 61 is formed with two flanges 63 engageable with lower slots 81 of the fixing member 8. The fixing member 8 has an upper slot 82 through which the stiffening board 9 may be inserted.

In use, first zip open the improved luggage. Then, engage the fixing member 8 with the mounting plates 6 so that the flanges 63 are inserted into the lower slots 81 of the fixing members 8, and fit the stiffening board 9 with the upper slots 82 of the fixing members 81. Since the wheel assemblies 7 are engaged with the mounting plates 6, the force exerted on the wheel assemblies 7 will be transmitted to the fixing members 8 and the stiffening board 9 thereby keeping the bottom side 11 of main body portion 1 flat and therefore, facilitating the movement of the luggage and preventing the bottom 11 from being damaged.

When not in use, first disengage the stiffening board 9 from the fixing members 8 and detach the fixing members 8 from the casters 6. Then collapse the luggage 100 to reduce the volume thereof.

While various changes and modifications might be proposed by those skilled in the art, it will be understood that I wish to include hereon all such changes and modifications as reasonably come within my contribution to the art.

I claim:

1. An improved luggage comprising:

a main body portion;

a lid hingedly attached to one side of said main body portion;

closure means provided on said main body portion and said lid for zipping up the luggage;

a supporting frame fastened on inner sides of said main body portion;

two fixing members each having an upper slot and two lower slots;

four casters mounted on the bottom of said main body portion, each said caster having a mounting plate fixedly attached to the bottom of said main body portion and a wheel assembly connected therewith, said mounting plate being formed with two flanges engageable with the lower slots of said fixing member; and a stiffening board engageable with the upper slot of said fixing members.

2. An improved luggage as claimed in claim 1, further comprising a pull strap which is attached to said main body portion and takes the form of a loop so as to facilitate the manual act of pulling the improved luggage.

3. An improved luggage as claimed in claim 1, wherein each said wheel assembly includes a bracket connected with the mounting plate via rivets and a wheel rotatably mounted in the bracket.

* * * * *